US006422714B1

(12) United States Patent
Hubbell

(10) Patent No.: US 6,422,714 B1
(45) Date of Patent: Jul. 23, 2002

(54) ILLUMINATED, SOLAR POWERED, VEHICLE ACTIVATED, TRAFFIC SIGN

(76) Inventor: David Hubbell, 112 Park Ave., Saranac Lake, NY (US) 12983

( * ) Notice: Subject to any disclaimer, the term of this patent is extended or adjusted under 35 U.S.C. 154(b) by 0 days.

(21) Appl. No.: 09/501,768

(22) Filed: Feb. 10, 2000

Related U.S. Application Data

(60) Provisional application No. 60/119,795, filed on Feb. 11, 1999.

(51) Int. Cl.[7] ..... F21W 111/02; F21K 2/00

(52) U.S. Cl. ..... 362/84; 362/812; 362/802; 362/183; 362/145

(58) Field of Search ..... 362/84, 812, 802, 362/253, 183, 145, 559

(56) References Cited

U.S. PATENT DOCUMENTS

| | | | | | |
|---|---|---|---|---|---|
| 3,026,498 | A | * | 3/1962 | Galliers | |
| 3,177,397 | A | | 4/1965 | Keeran | |
| 3,182,415 | A | | 5/1965 | Brooks | |
| 3,680,237 | A | | 8/1972 | Finnerty, Sr. | 40/130 M |
| 3,720,913 | A | | 3/1973 | Bradford | 340/31 R |
| 3,786,507 | A | * | 1/1974 | Hurd, Jr. | 343/7 |
| 4,290,047 | A | | 9/1981 | Latta, Jr. | 340/134 |
| 4,319,310 | A | | 3/1982 | Kingsley | 362/183 |
| 4,384,317 | A | | 5/1983 | Stackpole | 362/183 |
| 4,952,023 | A | | 8/1990 | Bradshaw et al. | 350/102 |
| 5,005,004 | A | | 4/1991 | Udofot | 340/600 |
| 5,021,715 | A | | 6/1991 | Smith et al. | 315/159 |
| 5,101,329 | A | | 3/1992 | Doyle | 362/183 |
| 5,134,550 | A | | 7/1992 | Young | 362/32 |
| 5,143,285 | A | | 9/1992 | Wise | |
| 5,160,111 | A | | 11/1992 | Hugron | 248/548 |
| 5,442,870 | A | | 8/1995 | Kochanowski | 40/582 |
| 5,518,561 | A | | 5/1996 | Rosa | 156/71 |
| 5,566,384 | A | | 10/1996 | Chien | 362/84 |
| 5,709,045 | A | | 1/1998 | Thelen | 40/544 |
| 5,759,671 | A | | 6/1998 | Tanaka et al. | 428/166 |
| 5,911,524 | A | * | 6/1999 | Wilton | 362/802 X |
| 6,131,321 | A | * | 10/2000 | Daigle, Jr. | 362/812 X |

* cited by examiner

*Primary Examiner*—Laura K. Tso
(74) *Attorney, Agent, or Firm*—Shlesinger, Arkwright & Garvey LLP

(57) ABSTRACT

An illuminated sign comprises a front lens having a sign legend; an electroluminescent panel disposed behind the lens to provide lighting to the sign legend; a power source operably connected to the electroluminescent panel; a first sensor responsive to the headlights of an approaching vehicle and connected to the electroluminescent panel to activate the electroluminescent panel upon detection of the headlights; and a second sensor responsive to ambient light and connected to the electroluminescent panel such that the electroluminescent panel is OFF during daylight.

38 Claims, 6 Drawing Sheets

FIG. 7
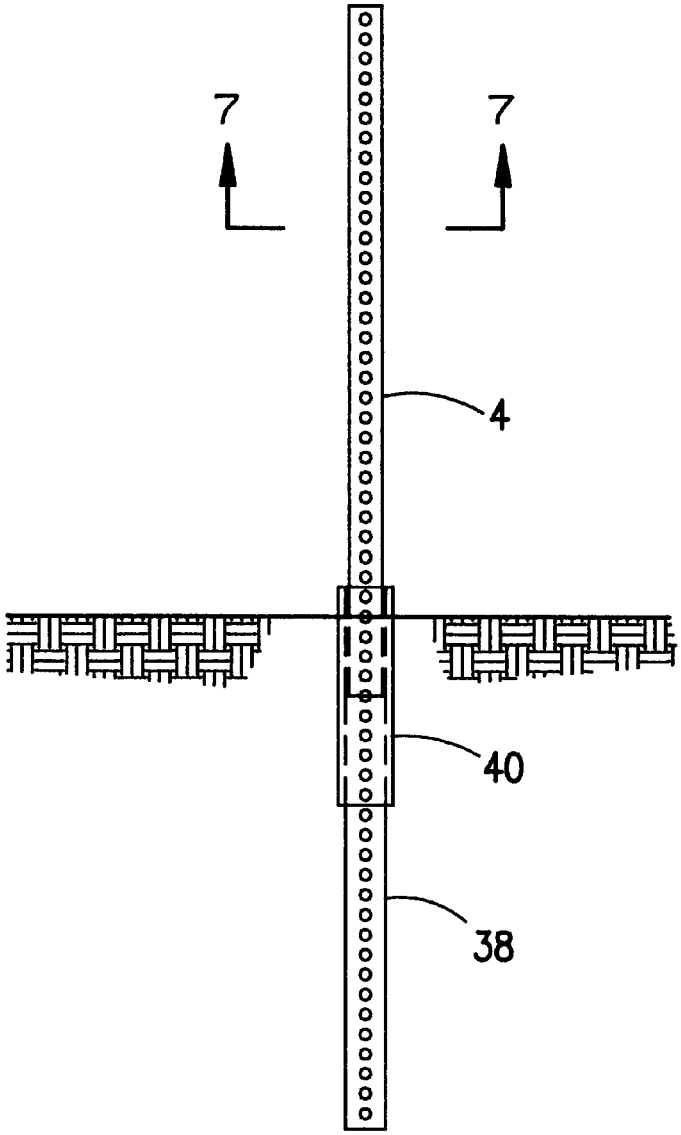
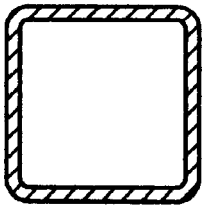
FIG. 8

ILLUMINATED, SOLAR POWERED, VEHICLE ACTIVATED, TRAFFIC SIGN

This application claims benefit of Prov. No. 60/119,795 filed Feb. 11, 1999.

FIELD OF THE INVENTION

The present invention relates to signs in general and to illuminated traffic highway signs, in particular, that meet the requirements of traffic highway design and traffic highway intersection design, signing signaling to improve safety and traffic flow on highways and highway intersections.

BACKGROUND OF THE INVENTION

Traffic signs, such as STOP signs, are not typically directly illuminated. Any illumination they get comes from indirect exterior light sources, such as street lights, vehicle headlights and other sources. The levels of illumination impinging on the signs would be highly variable at each location, with some signs receiving more than adequate illumination and other signs receiving minimal lighting, since street lights are generally provided for general illumination.

For traffic signs located in remote areas where utility power is not readily available, street lights would not generally be available to illuminate the traffic signs. In these areas, the traffic signs would only be illuminated by the vehicle headlights, which could be inadequate. For example, where the traffic sign is obscured by a blind curve, the sign would not be lit until the driver is almost in front of it. This may not provide the driver sufficient time to react safely.

There is, therefore, a need to have an illuminated traffic sign that is visible to a driver before the vehicle's headlights hit it without depending on ambient lighting sources for illumination.

The present invention provides a traffic sign that allows illumination of the sign without extensive maintenance costs and provides for identical appearance of the sign when both lit and unlit, while meeting the design code specifications required by the U.S. Transportation Department of regulatory highway signing set forth in the U.S. Department of Transportation Federal Highway Administration (FHWA) regulations, including NCHRP 350, Manual of Uniform Traffic Control Devices (MUTCD), the American Association of State Highway and Transportation Officials (AASHTO) or other design codes.

OBJECTS AND SUMMARY OF THE INVENTION

It is therefore an object of the present invention to provide an illuminated traffic sign that meets the various design code and regulatory restrictions while avoiding the disadvantages of the prior art.

It is another object of the present invention to provide a traffic sign that meets MUTCD requirements both when not illuminated and also when illuminated.

It is still another object of the present invention to provide a reflective sign which when illuminated either by an interior light source in accordance with the present invention or by an exterior light source, such as a car headlight, will appear the same to the driver, thereby avoiding confusion for the driving public.

It is a further object of the present invention to provide an illuminated sign which is easily seen at night before the sign's retro-reflective properties are activated by an exterior light source, such as a car's headlights as a car travels around a curve approaching an intersection, since a retro-reflective sign is only visible at night if a car is heading directly at the intersection.

It is another object of the present invention to provide a sign, such as STOP sign, which remains visible at night after an exterior light source is removed from shining directly at the sign. For example, a driver of an automobile can easily see the prior art STOP sign while the headlights are pointed at the sign, but as the car gets closer to the intersection the car's headlight will no longer shine directly on the STOP sign, throwing the sign into darkness.

It is still another object of the present invention to provide a relatively low cost and easy to maintain means of upgrading highway and intersection safety without the cost of exterior sign illumination equipment and/or traffic light signaling equipment.

In summary, the present invention provides a traffic sign illuminated by an interior electroluminescent lamp that meets the federal requirements for traffic signing when the sign is lit or unlit. The lamp may be activated by the vehicle's headlights and/or by radar detection and/or other such means. Utility or solar power, with battery backup, ensures reliable operation for the lamp.

The present invention provides an illuminated sign, comprising a sign panel; a light source disposed to illuminate the sign panel; a power source operably connected to the light source; and first and second switches connected in series between the power source and the light source such that the light source is activated only when the first and second switches are ON, wherein the first switch is turned ON by an approaching vehicle and the second switch is turned ON during daytime.

These and other objects of the present invention will become apparent from the following detailed description.

BRIEF DESCRIPTIONS OF THE DRAWINGS

FIG. 7 is a front elevational view of a post used in the present invention.

FIG. 8 is a cross-sectional view taken along line 7—7 of FIG. 7.

DETAILED DESCRIPTION OF THE INVENTION

The present invention will now be described using a STOP sign for illustrative purposes only and that a person skilled in the art will understand that the present invention can be used in any type of sign that provides greater visibility after daylight.

Figure 1:
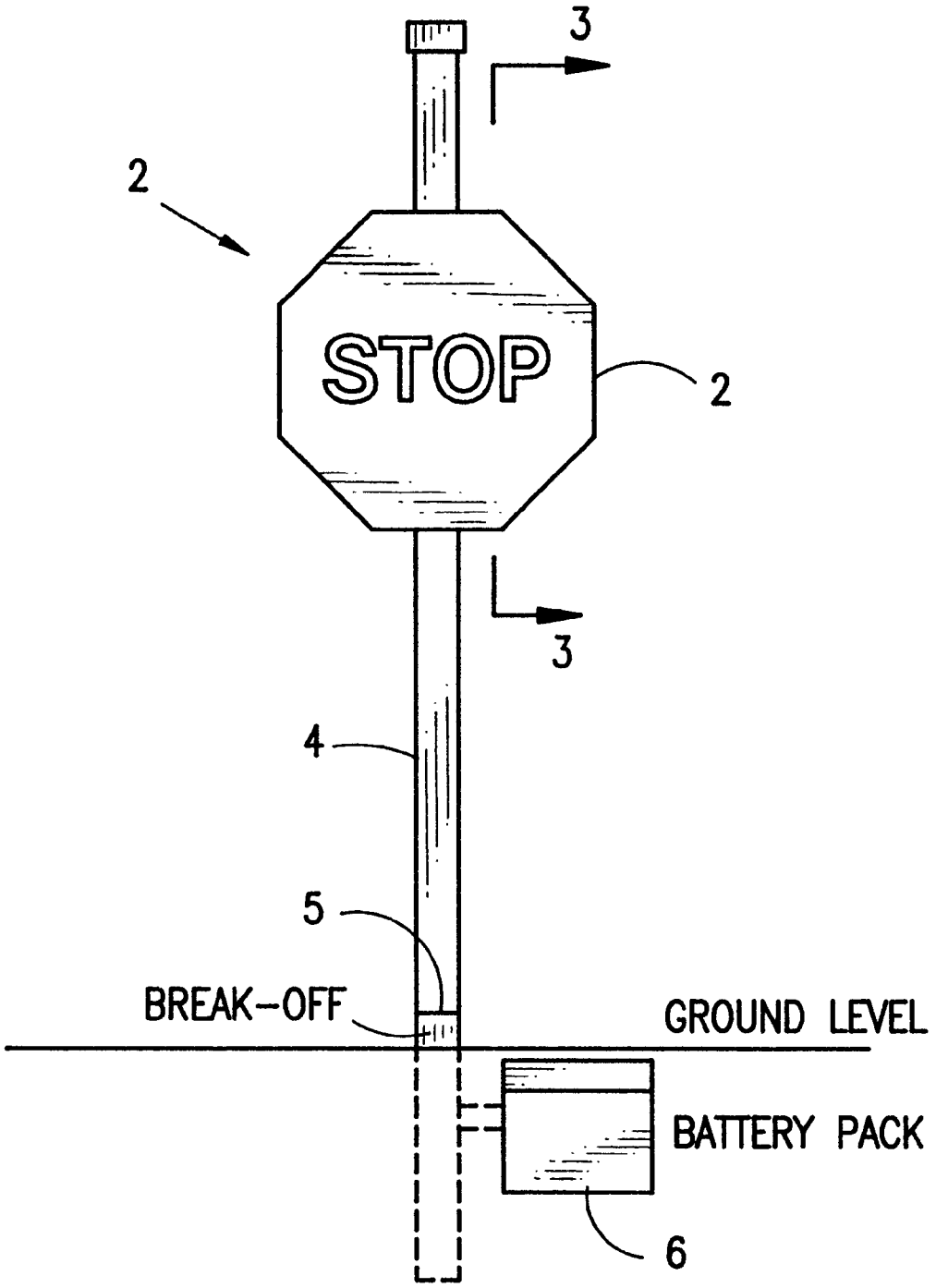
FIG. 1 is a front elevational view of a traffic sign made in accordance with the present invention.

A sign R made in accordance with the present invention is disclosed in FIG. 1. The sign R includes a sign panel 2 mounted on a post 4, which is properly anchored in the ground. The post 4 is made of standard construction, preferably hollow to function as a raceway for the electrical conductors that power the sign panel 2. The post 4 includes a standard break-off feature that allows the post 4 to yield relatively easily when struck by a vehicle. An underground vault 6 provides an enclosure for the electrical components of the sign R.

Figure 2:
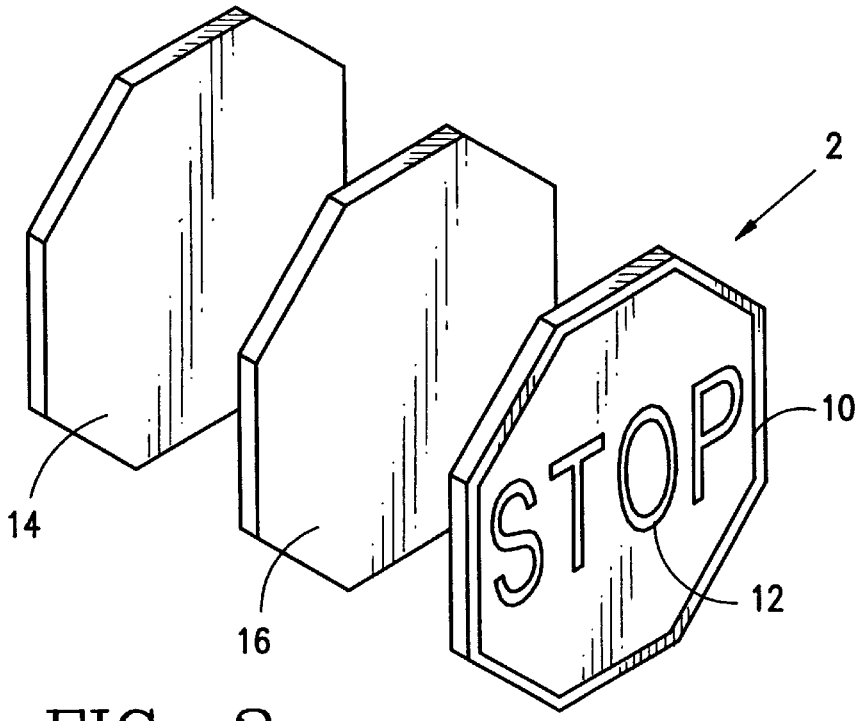
FIG. 2 is an exploded view of a sign panel made in accordance with the present invention.

The sign panel 2 includes a front lens 10 having a sign legend 12 capable of retro-reflection, as best shown in FIG. 2. The front lens 10 may be injection molded from plastic to form the sign legend 12 and may incorporate a protective surface to protect the legend 12 from UV light and other detrimental effects of the environment caused by pollutants, acid rain, mildew and airborne dust. U.S. Pat. No. 5,442,870 discloses an example of the front lens 10.

A backplate 14 provides support for an electroluminescent lamp 16 and the front lens 10. The backplate 14 may be made from injection molded plastic stabilized for UV radiation and incorporates standard mounting means, such as nuts or bolts made of stainless steel that are molded into the backplate 14 with reinforced mounting areas. A plurality of lamps and/or lens may be used in the sign's construction.

Figure 3:
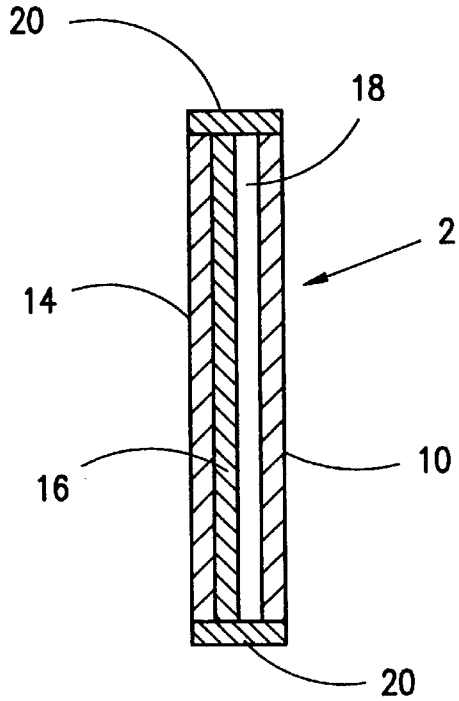
FIG. 3 is a cross-sectional view taken along line 3—3 in FIG. 1.

The lamp 16 is a solid-state plastic and/or ceramic electroluminescent light source with normal operating voltage of 150 VAC, 350–800 Hz. The lamp 16 will provide about 1.2 Foot Lamberts minimum at the operating voltage at 150 VAC/350 Hz and 6.0 Foot Lamberts minimum at the operating voltage at 150 VAC/800 Hz. The front surface of the lamp 16 is advantageously disposed at a distance from the back surface of the front lens 10 to generate a gap 18 to allow ambient light to enter from the edges 20 to further illuminate the sign 2, as best shown in FIG. 3. The edges 20 are made from translucent plastic materials to allow ambient light to shine into the gap 18.

The lamp 16 is powered from standard AC source 22, which is operably connected to a power supply and battery charger 24. A plurality of batteries 26 are disposed within the vault 6 and provide power to the sign 2.

Figure 4:
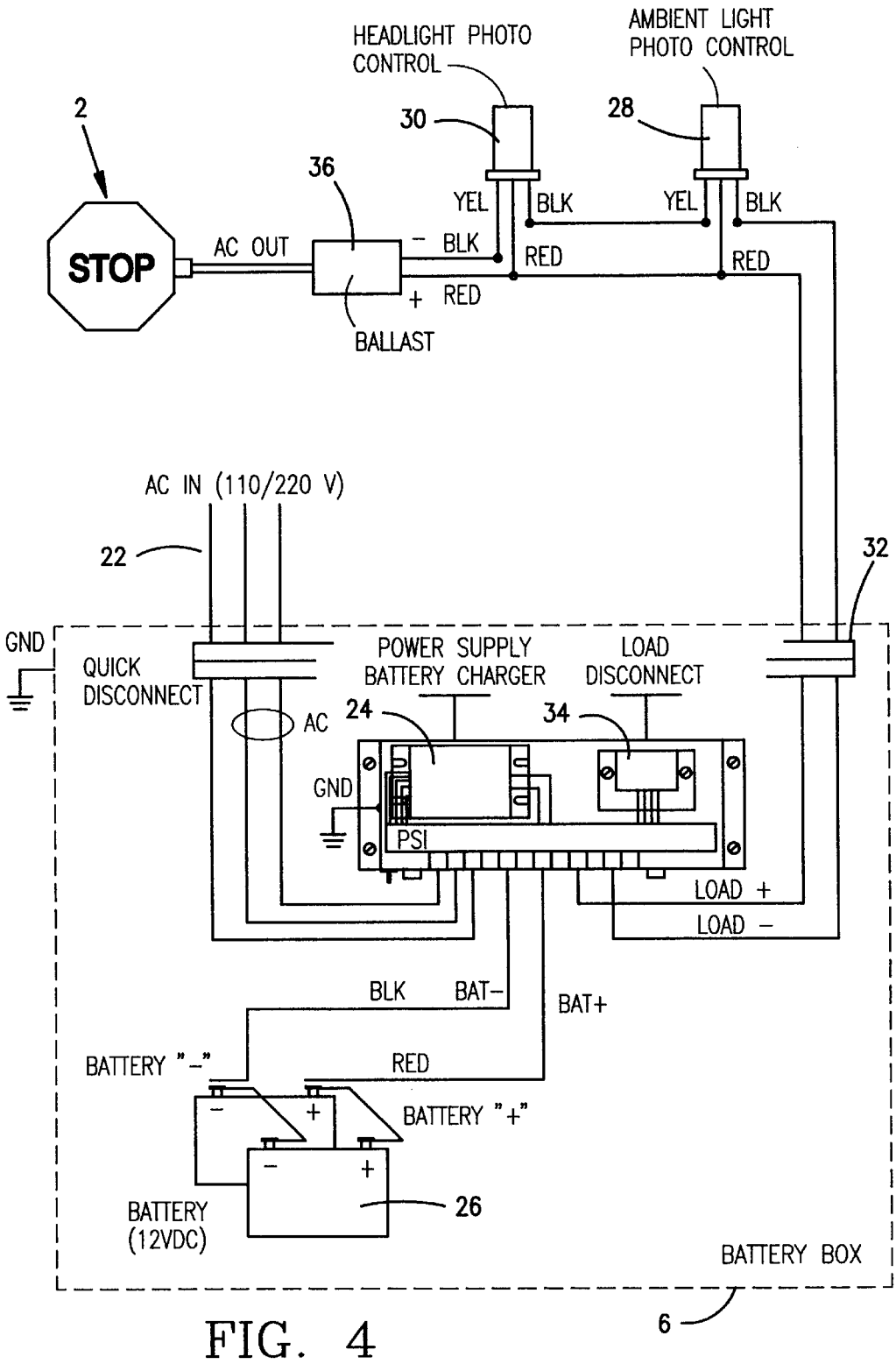
FIG. 4 is schematic wiring diagram used in the present invention.
Figure 5:
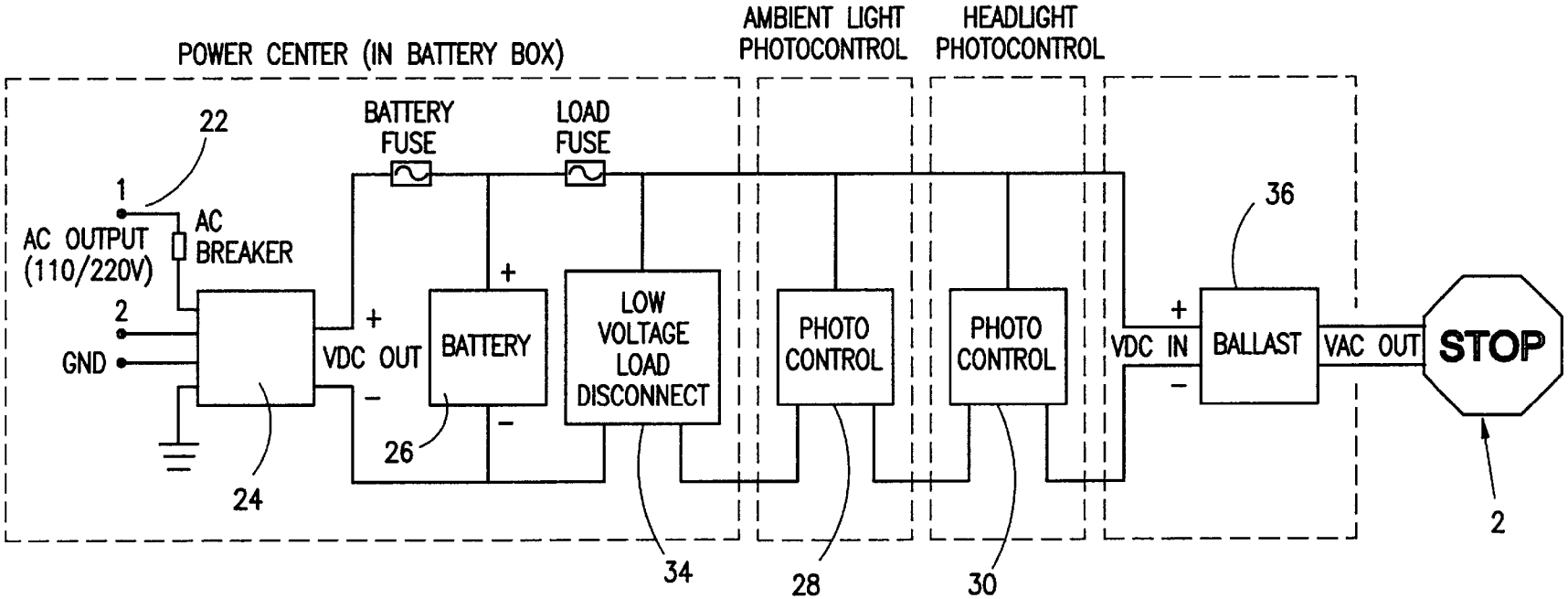
FIG. 5 is a system block diagram of the wiring schematic shown in FIG. 4.

Referring to FIGS. 4 and 5, photosensors 28 and 30 or other standard signaling means are provided to control the on/off operation of the sign. The photosensor 30 may be replaced with a standard radar-based sensor or other conventional sensing devices for sensing the approaching vehicle. The photosensors 28 and 30 are wired in series to the power source such that both photosensors must be conducting at the same time to illuminate the sign panel 2. Photosensor 28 may be eliminated where the sign is located in dark areas such as but not limited to tunnels and/or parking garages. The photosensor 28 is automatically activated at dusk and deactivated at dawn in response to ambient light level. The photosensor 28 is advantageously disposed such that it is shielded from street lights, lights from vehicle, or other sources of artificial light. The photosensor 30 is activated when it detects a vehicle's headlights. When both photosensors 28 and 30 are on, the lamp 16 is lit and illuminates the front lens 10, making the sign panel 2 quite visible to the driver. The photosensor 30 is advantageously directed down the road to catch an approaching vehicle's headlights before the vehicle gets near the intersection so that the sign is lit up before the driver reaches the sign. The photosensor 30 is shielded from ambient light and-other sources of artificial light. Upon detection of the approaching vehicle, the electroluminescent lamp 16 can be either simply turned on or be put into a flashing mode.

The photosensors 28 and 30 advantageously extend the life of the lamp by minimizing the time the lamp is on.

The photosensors 28 and 30 are appropriately secured to the post 4 or other advantageous locations.

A quick disconnect 32 is provided for disconnecting the power from the lamp 16 in the event that a vehicle impacts and topples the sign support 4, thereby preventing exposure of live wires.

Since the power supply 22 maintains the system batteries 26 at full charge during normal operation, an AC power failure will not affect the operation of the sign as long as battery power is available. To prevent battery damage due to excessive discharge during a prolonged AC power failure, a low voltage disconnect 34 is provided to automatically disconnect the lamp 16 from the battery power when a battery voltage of 11.2 VDC is reached. The disconnect 34 will automatically reconnect the lamp 16 when battery voltage is back up to 12.1 VDC.

A ballast 36 converts 12 VDC output of the power supply 34 or the batteries 26 to 180 VAC at 800 Hz. Since the lamp 16 will not properly operate from a standard residential power outlet at 120 VAC 60 Hz, the economic value of the sign without its power supply is substantially reduced, thereby providing a disincentive to theft. In addition, the vault 6 that houses the power supply to the sign may be disposed underground to further deter theft or vandalism.

Figure 6A:
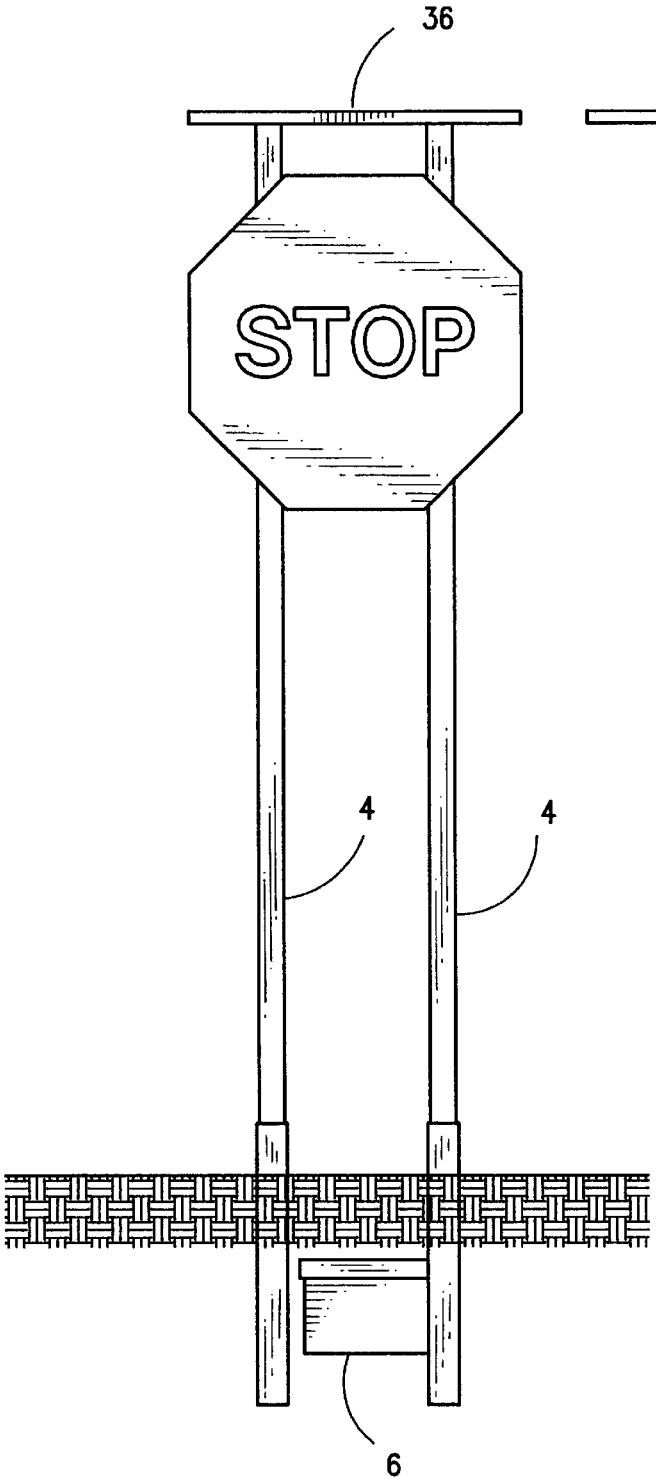
FIGS. 6A and 6B show another embodiment of the present invention, showing use of a solar panel.
Figure 6B:
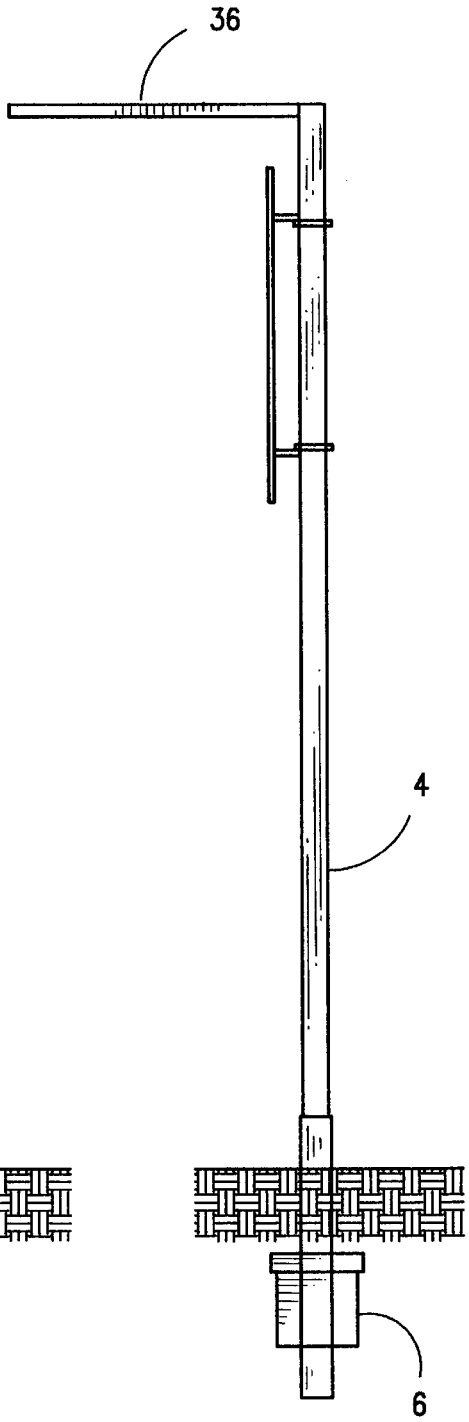

For an application where utility power is not available, the sign R may be outfitted with a solar panel 36. As best shown in FIGS. 6A and 6B. The solar panel 36 is operably connected to the battery charger 24 to charge the batteries 26 during daylight. The solar panel 36 is operably secured to the post 4 and extends forward over the sign panel 2 to advantageously shade the panel from street lighting.

The post 4 is shown in greater detail in FIGS. 7 and 8. The post R is hollow to function as a conduit for the wiring to the electroluminescent lamp 16 and to the solar panel 36, if used, and other control and monitoring instruments (not shown) that may be mounted on the sign. The post 4 includes an anchor post 38 and anchor sleeve 40.

The front lens 10 advantageously combines electroluminescent illumination from the lamp 16 with the retro-reflective cube corner construction disclosed in U.S. Pat. No. 5,442,870. Placement of the electroluminescent lamp 16 behind the retro-reflective cube corner face creates an internally illuminated highway design which meets the MUTCD requirements for non-internally illuminated traffic sign. The front lens 10 with its transparent areas allows light to pass through the face of the lens and to hit the face of the back of the lens. The light is then reflected off the smooth and glossy surface and strikes the back of the face where the surrounding exposed cube corners act as a light diffuser. The electroluminescent lamp 16 utilizes the properties of the front lens 10 when the level of ambient light is too low to illuminate the sign.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. An illuminated sign, comprising:

a) a sign panel;

b) a light source including an electroluminescent panel disposed to illuminate said sign panel;

c) a power source operably connected to said light source;

d) first and second switches connected in series between said power source and said light source such that said light source is activated only when said first and second switches are ON;

e) said first switch is turned ON by an approaching vehicle; and f) said second switch is turned OFF during daytime.

2. An illuminated sign as in claim 1, wherein said sign is a STOP sign.

3. An illuminated sign as in claim 1, wherein said sign is made of plastic.

4. An illuminated sign as in claim 3, wherein said sign includes retro-reflective portions.

5. An illuminated sign as in claim 1, wherein said light source is a solid-state plastic electroluminescent panel.

6. An illuminated sign as in claim 1, wherein said light source is a solid-state ceramic electroluminescent panel.

7. An illuminated sign as in claim 1, and further comprising a support disposed behind said electroluminescent panel.

8. An illuminated sign as in claim 7, wherein said support is made of plastic.

9. An illuminated sign as in claim 1, wherein said power source includes a battery.

10. An illuminated sign as in claim 9, wherein said power source includes a disconnect switch to automatically disconnect said battery from said light source when the battery voltage reaches a value.

11. An illuminated sign as in claim 10, wherein said disconnect switch automatically switches said battery to said light source when the battery voltage reaches another value.

12. An illuminated sign as in claim 1, wherein said power source includes a ballast.

13. An illuminated sign as in claim 1, wherein:

a) said first and second switches include first and second photosensors, respectively; and b) said first photosensor is turned ON by headlights of an approaching vehicle.

14. An illuminated sign as in claim 1, wherein said first switch is a radar-based sensor to detect an approaching vehicle.

15. An illuminated sign as in claim 14, wherein said second photosensor is automatically activated at dusk and de-activated at dawn in response to ambient light level.

16. An illuminated sign as in claim 1, and further comprising:

a) a post; and b) said sign panel and said light source are secured to said post.

17. An illuminated sign as in claim 16, and further comprising a disconnect switch operably connected to said power supply such that when said post is knocked down, said disconnect switch automatically disconnects said power source from said light source.

18. An illuminated sign as in claim 16, wherein said post includes a break-off portion to allow said post to yield when struck by a vehicle.

19. An illuminated sign as in claim 16, wherein said post is hollow.

20. An illuminated sign as in claim 16, wherein said post includes an anchor portion.

21. An illuminated sign as in claim 1, wherein said power source includes an underground enclosure.

22. An illuminated sign as in claim 1, wherein said power source includes a solar panel.

23. An illuminated sign, comprising:

a) a sign panel;

b) a light source disposed to illuminate said sign panel;

c) a power source operably connected to said light source;

d) a first sensor responsive to headlights of an approaching vehicle and connected to said light source to activate said light source upon detection of the headlights;

e) a second sensor responsive to ambient light and connected to said light source such that said light source is OFF during daylight.

24. An illuminated sign as in claim 23, wherein said light source is an electroluminescent panel disposed behind said sign panel.

25. An illuminated sign as in claim 24, wherein said electroluminescent panel is spaced apart from said sign panel to permit ambient light to enter therebetween.

26. An illuminated sign as in claim 23, wherein said power source includes a battery backup.

27. An illuminated sign as in claim 23, wherein said first and second sensors are photosensors.

28. An illuminated sign, comprising:

a) a front lens having a sign legend;

b) an electroluminescent panel disposed behind said lens to provide lighting to said sign legend;

c) a power source operably connected to said electroluminescent panel;

d) a first sensor responsive to headlights of an approaching vehicle and connected to said electroluminescent panel to activate said electroluminescent panel upon detection of the headlights; and e) a second sensor responsive to ambient light and connected to said electroluminescent panel such that said electroluminescent panel is OFF during daylight.

29. An illuminated sign as in claim 28, wherein said sign legend is retro-reflective.

30. An illuminated sign as in claim 28, wherein said first and second sensors are photosensors.

31. An illuminated sign, comprising:

a) a sign panel;

b) an electroluminescent light source disposed to illuminate said sign panel;

c) a power source operably connected to said light source;

d) a first sensor responsive to an approaching vehicle and connected to said light source to activate said light source upon detection of the vehicle; and e) a second sensor responsive to ambient light and connected to said light source such that said light source is OFF during daylight.

32. An illuminated sign, comprising:

a) a sign panel;

b) a light source disposed to illuminate said sign panel;

c) a power source including a battery operably connected to said light source;

d) first and second switches connected in series between said power source and said light source such that said light source is activated only when said first and second switches are ON;

e) said first switch is turned ON by an approaching vehicle;

f) said second switch is turned OFF during daytime;

g) said power source including a disconnect switch to automatically disconnect said battery from said light source when the battery voltage reaches a value.

33. An illuminated sign as in claim 32, wherein said disconnect switch automatically switches said battery to said light source when the battery voltage reaches another value.

34. An illuminated sign, comprising:

a) a sign panel;

b) a light source disposed to illuminate said sign panel;

c) a power source operably connected to said light source;

d) first and second switches connected in series between said power source and said light source such that said light source is activated only when said first and second switches are ON;

e) said first switch is turned ON by an approaching vehicle;

f) said second switch is turned OFF during daytime;

g) said first and second switches including first and second photosensors, respectively; and h) said first photosensor is turned ON by headlights of an approaching vehicle.

35. An illuminated sign, comprising:

a) a sign panel;

b) a light source disposed to illuminate said sign panel;

c) a power source operably connected to said light source;

d) first and second switches connected in series between said power source and said light source such that said light source is activated only when said first and second switches are ON;

e) said first switch is turned ON by an approaching vehicle;

f) said second switch is turned OFF during daytime; and g) said first switch is a radar-based sensor to detect an approaching vehicle.

36. An illuminated sign, comprising:

a) a sign panel;

b) a light source disposed to illuminate said sign panel;

c) a power source operably connected to said light source;

d) first and second switches connected in series between said power source and said light source such that said light source is activated only when said first and second switches are ON;

e) said first switch is turned ON by an approaching vehicle;

f) said second switch is turned OFF during daytime;

g) a post; and h) said sign panel and said light source are secured to said post.

37. An illuminated sign, comprising:

a) a sign panel;

b) a light source disposed to illuminate said sign panel;

c) a power source operably connected to said light source;

d) first and second switches connected in series between said power source and said light source such that said light source is activated only when said first and second switches are ON;

e) said first switch is turned ON by an approaching vehicle;

f) said second switch is turned OFF during daytime; and g) said power source including an underground enclosure.

38. An illuminated sign, comprising:

a) a sign panel;

b) a light source disposed to illuminate said sign panel;

c) a power source operably connected to said light source;

d) first and second switches connected in series between said power source and said light source such that said light source is activated only when said first and second switches are ON;

e) said first switch is turned ON by an approaching vehicle;

f) said second switch is turned OFF during daytime; and g) said power source including a solar panel.

* * * * *